US009260162B2

(12) United States Patent
Puustelli et al.

(10) Patent No.: US 9,260,162 B2
(45) Date of Patent: Feb. 16, 2016

(54) APPARATUS, AN ARRANGEMENT AND A METHOD FOR LOCKING AN UNDERWATER HATCH OR OTHER REMOVABLE STRUCTURE

(71) Applicant: Beacon Finland Ltd Oy, Rauma (FI)

(72) Inventors: Joonas Puustelli, Rauma (FI); Timo Rintala, Rauma (FI); Juhani Suutari, Rauma (FI); Olli Toivonen, Lappi (FI)

(73) Assignee: Beacon Finland Ltd Oy, Rauma (FI)

( * ) Notice: Subject to any disclaimer, the term of this patent is extended or adjusted under 35 U.S.C. 154(b) by 0 days.

(21) Appl. No.: 14/390,492

(22) PCT Filed: Apr. 3, 2013

(86) PCT No.: PCT/FI2013/000015

§ 371 (c)(1),
(2) Date: Oct. 3, 2014

(87) PCT Pub. No.: WO2013/150174

PCT Pub. Date: Oct. 10, 2013

(65) Prior Publication Data

US 2015/0203175 A1 Jul. 23, 2015

(30) Foreign Application Priority Data

Apr. 4, 2012 (FI) ..... 20125387
Apr. 26, 2012 (FI) ..... 20125461

(51) Int. Cl.
*E05C 17/44* (2006.01)
*B63B 19/24* (2006.01)
*E05C 17/30* (2006.01)

(52) U.S. Cl.
CPC ..... *B63B 19/24* (2013.01); *E05C 17/305* (2013.01); *Y10T 292/65* (2015.04)

(58) Field of Classification Search
CPC .. Y10T 292/202; B63B 19/24; B63B 19/197; F16J 13/18; E05B 65/001; B60P 3/226
USPC ..... 292/338, 256.5, 256.63
See application file for complete search history.

(56) References Cited

U.S. PATENT DOCUMENTS 3,164,403 A * 1/1965 Jerome ..... B63B 19/197 114/203
3,335,783 A 8/1967 Ligh ..... 160/188
3,888,528 A * 6/1975 Jericijo ..... B63B 19/24 114/203

(Continued)

FOREIGN PATENT DOCUMENTS

CN 202 055 675 11/2011
DE 24 17 250 11/1975

(Continued)

*Primary Examiner* — Mark Williams
(74) *Attorney, Agent, or Firm* — James C. Lydon

(57) ABSTRACT

The object of the invention is an apparatus for locking an underwater hatch or other removable or turnable structure (6) in a vessel or other floating structure, which comprises at least a locking rod (2), that is attachable in an articulated manner to the hull (7) or other structure of the vessel or other floating structure and which locking rod is, at its second end (2"), arrangeable in connection with a surface of the lockable hatch or other removable or turnable structure (6), a turning mechanism (3) of the locking rod (2), which comprises at least a first part (3') and a second part (3"), which are, at their first ends, attached to each other in an articulated manner, and of which a second end of the first part (3') is arranged in connection with the locking rod (2) in an articulated manner and a second end of the second part (3") is attachable in an articulated manner to the hull (7) or other structure of the vessel or other floating structure, and an actuator (4) that is arranged in connection with the turning mechanism (3).

18 Claims, 3 Drawing Sheets

(56) References Cited

U.S. PATENT DOCUMENTS

Figure 1:
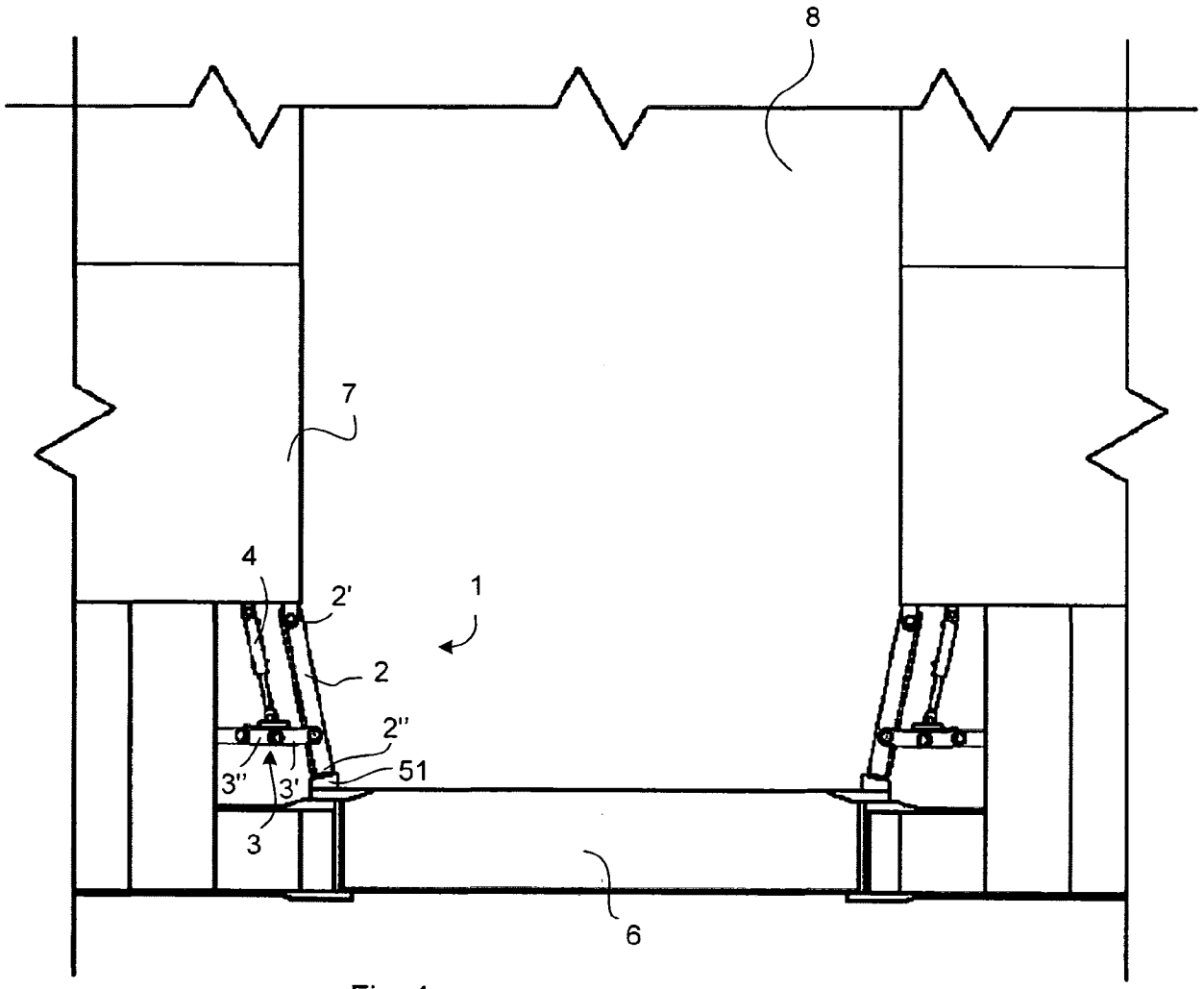

| | | | | | |
|---|---|---|---|---|---|
| 4,075,971 | A | | 2/1978 | Reginensi et al. | 115/41 R |
| 4,096,968 | A | * | 6/1978 | Treiber | F16J 13/18 220/244 |
| 4,655,004 | A | | 4/1987 | Caillet | 49/280 |
| 5,700,043 | A | * | 12/1997 | Rohard | G21F 5/12 292/161 |
| 6,109,823 | A | * | 8/2000 | Halferty | B65D 90/10 220/323 |
| 2012/0058694 | A1 | | 3/2012 | Krautkramer | 440/51 |

FOREIGN PATENT DOCUMENTS

| | | |
|---|---|---|
| EP | 0 098 218 | 1/1984 |
| FI | 122769 | 6/2012 |
| JP | 52-129198 | 10/1977 |
| KR | 2020090012823 | 4/2011 |
| SU | 1017585 | 5/1983 |
| WO | WO 02/090175 | 11/2002 |
| WO | WO 2005/025977 | 3/2005 |
| WO | WO 2010/136012 | 12/2010 |
| WO | WO 2011/127987 | 10/2011 |

* cited by examiner

APPARATUS, AN ARRANGEMENT AND A METHOD FOR LOCKING AN UNDERWATER HATCH OR OTHER REMOVABLE STRUCTURE

FIELD OF THE INVENTION

The invention relates to is an apparatus, an arrangement and a method for locking an underwater hatch or other removable or turnable structure in a vessel or other floating structure according to the preambles of the enclosed independent claims.

BACKGROUND OF THE INVENTION

A vessel or other floating structure such as drilling or service rigs or similar may comprise an underwater space for example as a service space or hoisting shaft for a propeller device or similar system. Such an underwater space comprises a closed or closable space into which an access for the crew is arranged from other parts of the vessel or similar floating structure, and which space is arranged in connection with the bottom or side of the vessel or similar floating structure, whereby the propeller device or similar system can be hoisted from its operation position up to the service/storage position in the service space and correspondingly lowered from the service space down to the operation position.

The underwater space is equipped with at least one watertight closing device, such as a hatch or other removable construction part, arranged in the bottom or side of the vessel or similar floating structure which when open form a direct connection from the underwater space into water in order to lower the propeller device from the service space into water to its operation position, i.e. its operation mode, and correspondingly to hoist from water inside the service space into service/storage position, i.e. service/storage mode, and which when closed forms a watertight space together with the other structures of the underwater space, from which water can be removed after closing the closing devices.

The opening of the underwater space is closed in a watertight manner by a hatch or other removable construction part that is in one or several parts, the construction part being typically attached to the hull structure of the vessel mechanically via bolts or other similar fastening means. When it is desired to open the hatch/hatches or removable construction part for hoisting or lowering the propeller device through the underwater opening, the hatch/hatches or removable construction part hoist up in their guides or turn to the side. The hatch/hatches or other removable construction part is opened/closed via an actuator designed for this purpose, and is kept temporarily locked via for example hydraulic cylinders or other similar actuators, in order to be able to remove or attach the mechanical fastening means such as bolts or similar, used for attaching the hatch or other construction part. The use of such solutions based on hydraulic cylinders as locking devices is problematic since they need operational energy in order to lock and to keep locked. The buoyancy force directed to underwater hatches is significant, thus the pressure directed to the cylinders is high and thereby the amount of operational energy is also significant. Moreover, such actuators are large, heavy and require space.

OBJECT AND DESCRIPTION OF THE INVENTION

An object of the present invention is to reduce or even eliminate the above-mentioned problems appearing in prior art.

An object of the present invention is to provide a solution for locking an underwater hatch or other removable structure in a vessel or other floating structure, which enables the temporary locking of the hatch or other similar structure in a manner as simple as possible and which arrangement does not need outside operational energy when the arrangement is in its locked mode.

It is especially an object of the invention to provide an arrangement, which enables the closing of a hatch or other removable structure also in a case where a side of the hatch or similar structure to be closed is not positioned in place in a tight manner when the hatch or structure is closed.

It is especially an object of the invention to provide a solution for temporary closing of a hatch or other removable structure used for closing a bottom or side opening of an underwater space in a vessel or other floating structure.

In order to achieve this object, the apparatus, arrangement and method for locking an underwater hatch or other removable or turnable structure in a vessel or other floating structure according to the invention are mainly characterised in what is presented in the characterising parts of the independent claims.

The other, dependent claims present some preferred embodiments of the invention.

A typical apparatus according to the invention for locking an underwater hatch or other removable or turnable structure in a vessel or other floating structure comprises at least

- a locking rod, that is attachable in an articulated manner to the hull or other structure of the vessel or other floating structure and which locking rod is, at its second end, arrangeable in connection with a surface of the lockable hatch or other removable or turnable structure,
- a turning mechanism of the looking rod, which comprises at least a first part and a second part, which are, at their first ends, attached to each other in an articulated manner, and of which a second end of the first part is arranged in connection with the locking rod in an articulated manner and a second end of the second part is attachable in an articulated manner to the hull or other structure of the vessel or other floating structure, and
- an actuator that is arranged in connection with the turning mechanism.

A typical arrangement according to the invention for locking an underwater hatch or other removable or turnable structure in a vessel or other floating structure comprises

- at least one apparatus according to the invention,
- a hatch or other removable or turnable structure, and
- a counterpart arranged on a surface of the hatch or other removable or turnable structure, with which the second end of the locking rod of the apparatus is arrangeable in connection.

In a typical method according to the invention for locking an underwater hatch or other removable or turnable structure in a vessel or other floating structure, the hatch or other removable or turnable structure is locked with at least one arrangement according to the invention in such a manner, that

- the locking rod is turned into a locking: position with the aid of a turning mechanism, which turning mechanism is moved with an actuator,
- the second end of the locking rod is arranged to face a counterpart arranged on a surface of the hatch or other removable or turnable structure,
- the turning mechanism is arranged into the locking position with the aid of the actuator, and
- the actuator is inactivated.

The embodiments presented in this application relate to the apparatus, arrangement and method according to the invention, even if this is not always separately mentioned. In this description, the term hatch is used for meaning both a hatch and other removable or turnable structures, and the term hatch is used alone for sake of clarity. Correspondingly, the term vessel means both vessels and other floating structures and the term vessel is used alone for sake of clarity.

The apparatus according to the invention for locking an underwater hatch, i.e. locking apparatus (or locking device, which term can also be used) comprises a locking rod, a turning mechanism for the locking rod and an actuator using the turning mechanism. The arrangement comprises, in addition to the apparatus, a hatch or similar and a counterpart compatible with the end of the locking rod, on the surface of the hatch or other similar structure.

The solution according to the invention enables temporarily locking an underwater hatch into place, when the mechanical fastening means, such as bolts or similar, are being removed or attached. The locking apparatus according to the invention is typically arranged in an underwater space of the vessel on the side of the hatch/hatches for closing the space, and attached to the wall of the underwater space.

The apparatus and arrangement according to the invention are attachable to the hull or other structure of the vessel, by which in this application it is meant that the parts of the apparatus and arrangement are attachable into any structure suitable with respect to its location.

The locking rod according to the invention is an elongated rod that comprises a first end and a second end. The locking rod can be attached in an articulated manner to the hull or other structure of the vessel around the lockable hatch at any possible position of the locking rod, depending on the embodiment. According to a preferred embodiment of the invention, the locking rod is attached in an articulated manner to the hull or other structure of the vessel and the second end of the locking rod is arranged in connection with a counterpart arranged on a surface of the hatch or other removable or turnable structure. In one embodiment of the invention, the locking rod is attached to place via its upper end and the lower end of the rod is arranged in connection with the hatch.

According to another embodiment, at least one wheel has been arranged at the second end of the locking rod facing the hatch. The at least one wheel is then arranged at the end of the locking rod in such a manner that the wheel catches a groove in the counterpart attached to the surface of the hatch before the end of the locking rod becomes opposite the counterpart in case an edge of the hatch has not been placed into place in a tight manner when the hatch has been put into its place, but remains slightly elevated from the level of the surface. Here, by a wheel it is meant a wheel, a roller or other similar rotatable piece that can be arranged at the end of the locking rod. The wheel is preferable arranged at the end of the locking rod in such a manner that its direction of rotation is the same as the direction of movement of the locking rod.

In a preferred embodiment of the invention, a pair of wheels comprising wheels arranged on both sides of the locking rod has been arranged at the second end of the locking rod. The wheels of the pair of wheels can be attached to each other through the locking rod. Typically, the wheels are attached to each other via an axis passing through the locking rod. The arrangement according to the invention may comprise several wheels arranged at the end of the locking rod in different manners depending on the applications of use. In one embodiment, the wheel or wheels can be arranged at the end of the locking rod in such a manner that the second end of the locking rod is in two parts and the wheel/wheels is/are arranged between these parts.

Typically the arrangement according to the invention comprises a counterpart arranged on the surface of the hatch, into which the second end of the locking rod is arrangeable in the locking position. The counterpart can be arranged on the surface of the hatch in a fixed or removable manner. According to an embodiment of the invention, the counterpart has been attached to a separate flange attached to the edge. The shape of the counterpart and the end of the locking rod being in connection with it can vary and they are designed on a case-specific case to fit one another. In an embodiment of the invention the counterpart is arranged such that its shape is compatible with the second end of the locking rod. According to one embodiment, the counterpart is integral with the surface of the hatch, i.e. the counterpart has been formed directly on the surface of the hatch and not attached to it as a separate part.

In the embodiment where at least one wheel has been arranged at the second end of the locking rod, has at least one groove compatible with the wheel and a portion compatible with the second end of the locking rod been arranged in the counterpart. If there are two wheels, grooves compatible with the wheels of a pair of wheels are arranged on the sides of the counterpart and the portion of the counterpart between the grooves is arranged to be compatible with the second end of the locking rod.

Thus when needed, the counterpart arranged on the surface of the hatch comprises in addition at least one groove compatible with the wheel and a portion compatible with the second end of the locking rod. The groove or grooves compatible with the wheel at the end of the locking rod may be essentially lower in the height direction of the counterpart than the portion compatible with the second end of the locking rod. According to an embodiment, the height of the counterpart with respect to the surface of the hatch is increasing from the edge of the hatch towards its center. In this case, in the embodiment with wheels, the at least one wheel at the end of the locking rod moves in the groove/grooves upwards and at the same time presses the edge of the hatch into place. When the wheel is sufficiently advanced in the groove, the end of the locking rod comes into contact with the middle of the counterpart and thus the wheel detaches from the surface of the groove. Thereby the wheel arranged at the end of the locking rod helps in closing the hatch by pressing the hatch towards its closed position, but when the hatch is tightly in place, the end of the rod is positioned against the counterpart and keeps the hatch in place. Therefore the wheel or wheels at the end of the locking rod are not used for carrying the load of the hatch but only as locking rod proper.

According to preferred embodiment of the invention, when a pair of wheels is arranged at the end of the locking rod, which wheels are arranged on different sides of the locking rod, grooves compatible with the wheels of a pair of wheels are arranged on the sides of the counterpart and the portion of the counterpart between the grooves, the so-called middle portion, is arranged to be compatible with the second end of the locking rod. In this embodiment the grooves on the sides of the counterpart are essentially lower in the height direction of the counterpart, than the middle part of the counterpart between the grooves.

In one preferred embodiment of the invention, a support, that is arrangeable to be compatible with a counterpart on the surface of the hatch, is arranged at the second end of the locking rod that comes against the hatch. Thus, in the locking position of the apparatus according to the invention, the support fits into the counterpart arranged on the hatch/hatches or removable structural part. The aim of this support at the lower end of the locking rod is to adjust the clearance between the locking rod and the counterpart arranged on the hatch/hatches.

The support can be fixed or adjustable, that is, it can be made in such a manner that the counterpart is adjusted to be compatible with the lower end of the locking rod already during the construction, or it can be made adjustable in case for example the locking rod needs to be changed during the use of the vessel.

When the hatch/hatches are locked with a locking apparatus according to the invention, the locking rod is turned into locking position (into connection with the counterpart on the surface of the hatch) by the turning mechanism connected to it. The turning mechanism is activated with the actuator which is arranged in connection with the turning mechanism. The turning mechanism of the locking rod of the locking apparatus according to the invention comprises at least two movable parts attached to each other, a first part and a second part, which are, at their first ends, attached to each other in an articulated manner. Of these parts attached to each other in an articulated manner, the first part is, at its free end, attached in an articulated manner to the locking rod and the second part is, at its free end, attached in an articulated manner to the hull or other structure of the vessel, typically to the wall of the underwater space. The attachment of the turning mechanism to the locking rod can be chosen case-specifically. In one preferred embodiment of the invention, the turning mechanism is attached to the locking rod in an area between the second end (the end coming into contact with the surface of the hatch) and the middle of the locking rod, when the locking rod is attached to the hull from its first end. In another embodiment of the invention, the turning mechanism is attached to the end of the locking rod and the locking rod is attached to the hull at a point near the middle of the locking rod, in its length direction.

The actuator in the locking apparatus is arranged in connection with the articulated structure of the turning mechanism. The parts of the turning mechanism which are attached to each other in an articulated manner are turned by the actuator in such a manner that the second end of the locking rod can be arranged in connection with the surface of the hatch.

According to an embodiment, the first part and the second part of the turning mechanism attached to each other in an articulated manner are lockable when a pivot point between them is bent outward from a direction of a plane, while the parts are arranged essentially in a same plane.

In an locking apparatus according to the invention the locking rod can be locked in such a manner that the parts of the turning mechanism which are attached to each other in an articulated manner are, depending on the assembly point of the actuator, either pushed or pulled with the aid of the actuator at their articulation point, until they lock one another. The turning mechanism is then a so-called set-locking articulation system, in which parts of the turning mechanism attached to each other in an articulated manner are lockable when the articulation point between them is bent outward from the direction of the plane, while the parts are arranged essentially in a same plane. When the turning mechanism is arranged in the apparatus in horizontal direction, the articulation point is bent outward from the horizontal direction while the parts are arranged essentially in a same plane in the horizontal direction. That is to say, the parts of the turning mechanism bend at their articulation point a bit over and thereby the articulation system locks. While the locking rod is in the locked position, the turning mechanism is positioned in such a manner that the actuator using it is not under charge and does not need operational energy, whereby the locking rod stays at the locked-position without outside energy.

When the locking of the locking rod is wished to be opened, the actuator frees the turning mechanism, which turns the locking rod into the open-position. In the open-position the parts of the turning mechanism that are articulated to each other are bent preferably from the direction of the plane towards each other. It follows then that the locking rod turns to the side and frees the from the locking.

The actuator used in a locking apparatus according to the invention may be any actuator suitable for this use, for example an actuator based on hydraulics, pneumatics, mechanics or electricity. According to an embodiment of the invention, the actuator can be a hydraulic cylinder, a pneumatic cylinder, a drive screw or another similar actuator. According to an embodiment of the invention, the actuator is attachable to the hull or other structure of the vessel. The actuator can thus be attached in an articulated manner to the hull or other structure of the vessel around the hatch or other removable structure. The actuator can be arranged in the apparatus in such a manner that it either pushes or pulls the turning mechanism.

According to an embodiment of the invention, the locking rod, the second end of the second part of the turning mechanism and the actuator are arranged in an articulated manner to a wall of the underwater space. According to a preferred embodiment of the invention the underwater space comprises a hollow recess for the edge of the hatch or other openable structure, into which hollow recess the locking apparatus according to the invention is arranged. In an apparatus according to the invention, the locking rod and the actuator are typically parallel and the turning mechanism is typically arranged in the apparatus such that in the locked-position it is essentially perpendicular to the locking rod and the actuator. In one embodiment of the invention, the locking rod and the actuator are attached in an articulated manner to the roof-part of the hollow recess of the underwater space such that they are in the locking apparatus essentially parallel and the turning mechanism is attached in an articulated manner to the vertical wall of the hollow recess such that it is arranged essentially perpendicular to the locking rod and the actuator.

According to one embodiment of the invention, the underwater hatch is a hatch or other removable or turnable structure closing an opening in the bottom or side of an underwater space of the vessel.

The locking apparatus according to the invention is meant for locking hatches used for closing underwater spaces in vessels. Typically the underwater spaces are located partly or fully under the level of water. The locking apparatus according to the invention can be used to lock a hatch or other removable or turnable structure on the bottom or side of the vessel. By other removable or turnable structural part is meant for example support structure of propeller device. The hatches and other structural parts may consist of one or several parts. The underwater hatch or other removable structure of the vessel or other floating structure may comprise one or more locking apparatuses according to the invention, depending on the size of the hatch or removable structure. Typically several locking apparatuses with their counterparts are arranged in the structure around the hatch or removable structure.

According to an embodiment of the method according to the invention, an at least one wheel arranged at the second end of the locking rod is arranged in connection with a groove or grooves of the counterpart.

SHORT DESCRIPTION OF THE DRAWINGS

Figure 2:
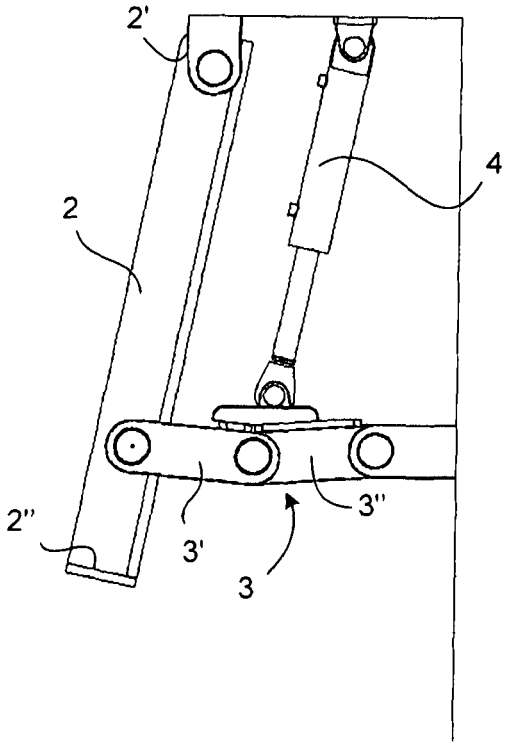
Figure 3:
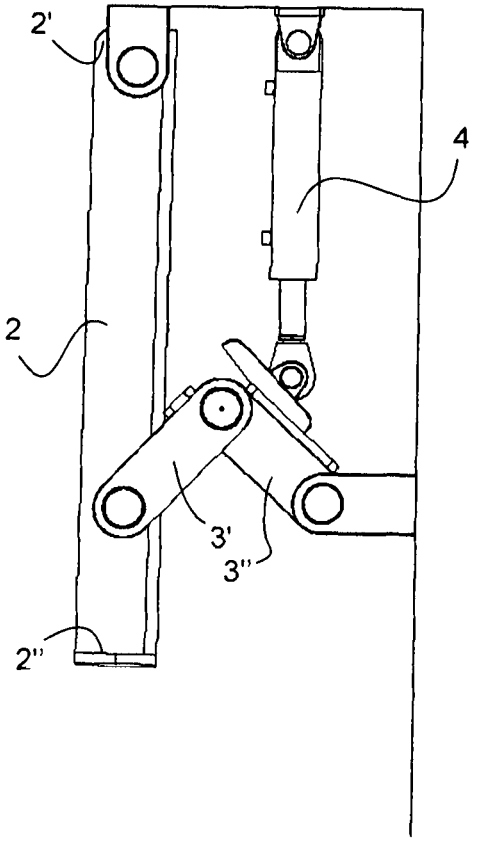
Figure 4:
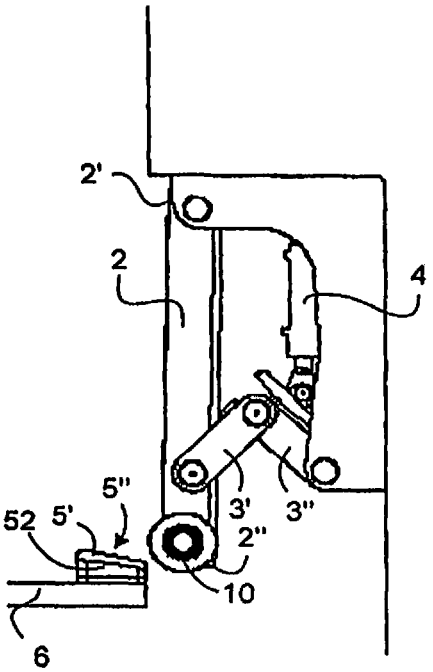
Figure 5:
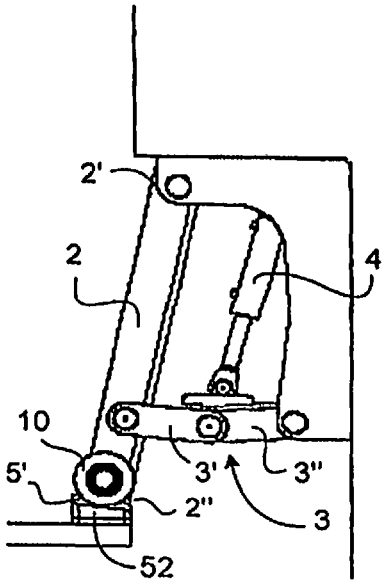

In the following, the invention will be described in more detail with reference to the appended drawings, in which FIG. 1 illustrates an arrangement according to the invention for locking an underwater hatch or other structure, FIG. 2 illustrates an arrangement according to the invention in closed position, FIG. 3 illustrates the arrangement according to FIG. 2 in open position, FIG. 4 illustrates another arrangement according to the invention in open-position, FIG. 5 illustrates the arrangement according to FIG. 4 in locked-position.

DETAILED DESCRIPTION OF THE DRAWINGS

FIG. 1 illustrates, as an example, an arrangement 1 according to an embodiment of the invention, it which the locking apparatuses are in the locked-position, thereby closing a hatch in the bottom of the vessel. FIG. 2 illustrates an arrangement according to the invention in open-position and FIG. 3 illustrates the arrangement according to FIG. 2 in locked-position. FIG. 4 illustrates another arrangement according to the invention in open-position and FIG. 5 the same arrangement in locked-position. Same reference signs have been used in the Figures for parts corresponding to each other.

In FIG. 1, the locking apparatus 1 has been arranged in an underwater space 8 of a vessel, which space 8 has been closed in a watertight manner by a hatch 6. The locking apparatus 1 has been arranged for example on the outer edge of a hatch arranged in a hollow recess arranged in the underwater space.

The arrangement according to the invention shown in FIG. 1 comprises a locking rod 2, which is attached in an articulated manner from its first end 2' to the hull 7 of the vessel. The second end 2" of the locking rod 2 comprises an adjustable support that enables arranging the locking rod 2 with the counterpart 51 when the locking rod is locked. The counterpart 51 is arranged on the surface of an openable or removable hatch 6.

The locking rod 2 is moved by the turning mechanism 3 and the actuator 4 in connection with it. The turning mechanism 3 comprises at least two movable parts 3' and 3", which are, at their first ends, attached to each other in an articulated manner, and a second end of the first part 3' is arranged in connection with the locking rod 2 in an articulated manner and a second end of the second part 3" is attached in an articulated manner to the hull of the vessel. The actuator 4 is arranged in connection with the turning mechanism 3 in such a manner that with its aid, the turning mechanism 3 is turned, whereby the locking rod 2 moves to open- or closed-position. The actuator 4 is attached in an articulated manner to the hull 7 of the vessel. The locking rod 2 and the actuator 4 are essentially parallel in the locking apparatus 1 and the turning mechanism 3 is essentially horizontal with respect to the locking rod and the actuator.

FIG. 1 shows two locking apparatuses according to the invention arranged on opposite sides, of the hatch 6 used for closing the underwater space.

FIG. 2 shows, that when the locking apparatus is locked, the articulation point between the parts 3' and 3" of the turning mechanism articulated to each other locks, when the articulation point moves a bit over, i.e. in the case of the locking apparatus shown in the Figure, below the horizontal position. The actuator 4 in connection with the turning mechanism is used for activating the turning mechanism. When the locking apparatus is opened the articulation point between the parts 3' and 3" of the turning mechanism 3 articulated to each other raises up and thereby the locking rod 2 turns to the side as is shown in FIG. 3.

FIGS. 4 and 5 illustrate another arrangement according to the invention, in which at least one wheel 10 is arranged at the second end 2" of the locking rod, which wheel can be arranged into connection with a groove 5' in a counterpart 52, for example with a groove 5' arranged on the side of the counterpart as is show in the Figures. The second end 2" of the locking rod is positioned against the middle 5" of the counterpart when the locking rod is locked. The shape of the counterpart is increasing with respect to the level of the hatch from the edge of the hatch towards its middle, thus with the aid of the wheel 10, the hatch 6 can be pushed downwards, so that the end 2" of the locking rod can be arranged against the middle 5" of the counterpart.

In FIG. 4, the arrangement is shown in the open-position, where the articulation point between the parts 3' and 3" of the turning mechanism 3 articulated to each other has been raised and thereby the locking rod 2 has turned to the side. FIG. 5 illustrates an arrangement according to the invention in locked-position, wherein the second end 2" of the locking rod is arranged in connection with the portion 5", which in this embodiment is the middle, of the counterpart 52. The wheel 10 at the end of the locking rod can be arranged in connection with a groove 5' at the edge of the counterpart 52. When the locking apparatus is locked, the articulation point between the parts 3' and 3" of the turning mechanism 3 articulated to each other locks and the wheel 10 detaches from the groove 5', whereby the charge exerted towards the locking apparatus is directed to the locking rod 2 proper.

The invention is not intended to be limited to the above-presented exemplary embodiments, but the intention is to apply the invention widely within the inventive idea defined by the claims defined below.

The invention claimed is:

1. An apparatus for locking a lockable underwater hatch or other removable or turnable structure (6) in a vessel or other floating structure, the apparatus comprising a locking rod (2), having a first end (2') that is attachable in an articulated manner to a hull (7) or other structure of the vessel or other floating structure, said locking rod having a second end (2"), adapted to engage a surface of the lockable hatch or other removable or turnable structure (6) in a locked position, a turning mechanism (3) comprising a first part (3') having a first end and a second part (3") having a first end, where the first part and the second part are, at their first ends, attached to each other in an articulated manner, wherein a second end of the first part (3') is operably attached to said locking rod (2) in an articulated manner and a second end of the second part (3") is attachable in an articulated manner to the hull (7) or other structure of the vessel or other floating structure, and an actuator (4) that is operably attached to said turning mechanism (3), such that said first end (3') and said second end (3") are turned by the actuator so that said second end of said locking rod (2) is moved toward or away from said locked position;

wherein said locking rod (2), turning mechanism (3) and actuator (4) are configured such that said actuator (4) does not require operational energy to maintain said locking rod (2) in said locked position.

2. An apparatus according to claim 1, said second end (2") of locking rod (2) comprises a support adapted to be engage a counterpart (51, 52) on said surface of the hatch or other removable or turnable structure (6).

3. An apparatus according to claim 1, further comprising at least one wheel (10) arranged at said second end (2") of locking rod (2).

4. An apparatus according to claim 3, wherein a pair of wheels (10) one arranged on each side of locking rod (2), is arranged at said second end (2").

5. An apparatus according to claim 1, wherein the first part (3') and the second part (3") are lockable when a pivot point between them is bent outward from a direction of a plane, while the parts (3', 3") are arranged essentially in a same plane.

6. An apparatus according to claim 1, wherein said actuator (4) is a member of the group consisting of a hydraulic cylinder, a pneumatic cylinder, and a drive screw.

7. An apparatus according to claim 1, wherein said actuator (4) is attachable to hull (7) or other structure of the vessel or other floating structure.

8. An apparatus according to claim 1, wherein said turning mechanism (3) is attached to locking rod (2) in an area between said second end (2") and a middle of said locking rod.

9. An arrangement for locking an underwater hatch or other removable or turnable structure (6) in a vessel or other floating structure, comprising at least one apparatus according to claim 1, a hatch or other removable or turnable structure (6), and a counterpart (51, 52) arranged on a surface of said hatch or other removable or turnable structure (6), and adapted to be engaged with said second end (2") of locking rod (2) of the apparatus (1).

10. An arrangement according to claim 9, wherein said counterpart (51, 52) is arranged such that its shape is compatible with the second end (2") of locking rod (2).

11. An arrangement according to claim 10, wherein at least one wheel (10) is arranged at said second end (2") of locking rod (2) and wherein said counterpart (52) comprises at least one groove (5') compatible with the wheel (10) and a portion (5") compatible with the second end (2") of locking rod (2).

12. An arrangement according to claim 11, wherein said grooves (5') are arranged on opposite sides of counterpart (52) and wherein portion (5") is arranged to be compatible with second end (2") of locking rod (2).

13. An arrangement according to claim 9, wherein a height of the counterpart (51, 52) with respect to the surface of the hatch or other structure (6) increases from an edge of the hatch or other structure (6) towards its center.

14. An arrangement according to claim 11, wherein groove or grooves (5') is/are lower in the height direction of counterpart (52) than the portion (5") compatible with the second end (2") of locking rod.

15. An arrangement according to claim 9, wherein underwater hatch or other removable or turnable structure (6) closes an opening in the bottom or side of an underwater space (8) in a vessel or other floating structure.

16. An arrangement according to claim 9, wherein locking rod (2), second end of the second part (3") of turning mechanism (3) and actuator (4) are arranged in an articulated manner a wall of underwater space (8).

17. A method for locking an underwater hatch or other removable or turnable structure (6) in a vessel or other floating structure, comprising locking the hatch or other removable or turnable structure with at least one arrangement according to claim 9, such that turning locking rod (2) into a locking position by turning mechanism (3), which is moved by actuator (4), moving a second end (2") of locking rod to face a counterpart (51, 52) on a surface of the hatch or other removable or turnable structure (6), moving turning mechanism (3) into the locking position by actuator (4), and inactivating actuator (4).

18. A method according to claim 17, wherein at least one wheel arranged at the second end (2") of locking rod is arranged in connection with a groove or grooves (5') of the counterpart (52).

* * * * *